US005848641A

United States Patent [19]

Epp

[11] Patent Number: 5,848,641

[45] Date of Patent: Dec. 15, 1998

[54] WELL PUMP PULLER

[76] Inventor: Peter Epp, 1613A South Lakeside Dr., Williams Lake, British Columbia, Canada, V2G 3A8

[21] Appl. No.: 774,251

[22] Filed: Nov. 14, 1996

[51] Int. Cl.[6] ..... E21B 19/22

[52] U.S. Cl. ..... 166/77.2; 166/85.5

[58] Field of Search ..... 166/77.2, 77.1, 166/85.5, 384, 385, 379, 68, 68.5

[56] References Cited

U.S. PATENT DOCUMENTS

| | | | |
|---|---|---|---|
| 2,798,435 | 7/1957 | Armstrong | 166/68 |
| 3,841,407 | 10/1974 | Bozeman | 166/384 |
| 4,003,435 | 1/1977 | Cullen et al. | 166/77.2 |
| 4,295,801 | 10/1981 | Bennett | 417/397 |
| 4,673,035 | 6/1987 | Gipson | 166/85.5 |
| 4,685,516 | 8/1987 | Smith et al. | 166/65.1 |
| 5,538,092 | 7/1996 | Precopia | 175/74 |
| 5,638,904 | 6/1997 | Misselbrook et al. | 166/384 |

*Primary Examiner*—Hoang C. Dang
*Attorney, Agent, or Firm*—Lee, Mann, Smith, McWilliams, Sweeney & Ohlson

[57] ABSTRACT

An apparatus for raising and lowering a submersible pump in a well. A cylindrical drum for reeling flexible water pipe is mounted for rotation at one side of the well. A cavity is provided in the drum for accommodating connectors or other large items at the top of the well, and a guide is provided at the top of the well for guiding water pipe vertically from the well and substantially horizontally to the cylindrical drum. An electric drive is provided for rotating the drum, the drive being mounted to accommodate sudden stopping of the drum due to jamming of the submersible pump or the water pipe secured to the pump as the pump is being withdrawn from the well.

19 Claims, 11 Drawing Sheets

WELL PUMP PULLER

BACKGROUND OF THE INVENTION

This invention relates to wells having submersible pumps, and in particular to an apparatus for raising or lowering the submersible pump in the well.

Modern water wells are drilled into the ground, and the well bore is protected by a casing which is sunk into the well. Typically, a submersible pump is then threaded down the casing and submerged in water located at the bottom of the well. The pump provides water to the surface through a flexible drop pipe connected to the pump and leading up the well bore to a connection located well below the ground surface below the frost line to prevent any winter freezing. A separate safety rope or cable is also provided, connected to the pump and extending the length of the bore to assist withdrawal of the submersible pump from the well bore if the pipe were to separate or break. In addition, since the submersible pump is electrically driven, a power cord also extends from the surface down the bore to the pump, attached to the flexible pipe.

On occasion, it is necessary to access the submersible pump, either for servicing or replacement, or because the pump must be relocated at a different elevation in the well bore. In the past, when removal of the submersible pump was necessary, often the pump has been physically removed from the well bore by simply raising the pump by the flexible water pipe. Since well bores can be hundreds of feet deep, this results in hundreds of feet of length of water pipe and cord and cable which must be accommodated. In the past, the pipe, cord and cable were typically simply laid on the ground. That, however, is unsanitary and can lead to contamination of the well when the pump, power cord and safety rope are returned to the well bore. That, in turn, can lead to expensive remediation to remove the contamination.

Removal of submersible pumps in the past has been by a variety of methods. In more shallow wells, where the weight of the pump and the flexible water pipe is relatively small, physical manual hoisting of the pump and pipe has proven effective, although subject to the contamination as just discussed. In addition, various devices have been developed over the years for removing submersible pumps, and U.S. Pat. Nos. 3,376,933; 3,871,618; 4,296,916; 4,986,351 and 5,253,845 are examples of various pump and pipe handling apparatus. However, again, such apparatus does not accommodate what can be considerable lengths of flexible water pipe and cables, leading to potential contamination of the well when reassembled.

SUMMARY OF THE INVENTION

The invention comprises an apparatus for raising and lowering a submersible pump in a well by the flexible pipe attached to the pump. The apparatus includes a cylindrical drum for accumulating flexible water pipe. Means is provided for mounting the drum for rotation at one side of the well, while spaced from the well. A cavity is provided in the drum for accommodating a connector or other large element situated at the top of the water pipe as the water pipe and the submersible pump are being withdrawn from the well. Guide means is provided for guiding water pipe from the well to the drum, and drive means is provided for rotating the drum for raising or lowering the submersible pump.

In accordance with the preferred form of the invention, the mounting means comprises a cart having an elongated frame. The frame includes means for mounting one end of the frame on the guide means, with that mounting means preferably comprising a handle located at one end of the frame. The cart is portable, and includes a series of wheels to facilitate portability. Brake means is provided for inhibiting rotation of at least one of the wheels for retaining the frame and the cylindrical drum in a stationary location.

The cavity in the stationary drum is located in a central hub of the drum. A cover is provided to close the cavity, and means is provided to secure the cover on the drum. A brake is also provided for the cylindrical drum to inhibit its motion, and a hand lever is provided for operating the brake as needed.

The guide means comprises a guide roller which is mounted for rotation in a bracket. The bracket includes means for attachment at the water well. The attachment means, in the preferred form of the invention, comprises a depending finger spaced from and secured to the bracket so that the bracket can be mounted on a well casing or an adaptor provided for securing to the well casing. An alignment roller is also provided in the bracket in registration with the guide roller to properly guide the flexible water pipe as it emerges from or is returned to the well. The bracket also includes means for retaining the handle so that the frame and drum are located at a proper orientation and elevation in relation to the well.

The invention also includes an adaptor for securing the bracket to the well. The adaptor includes an upstanding brace which is shaped with a similar curvature to the well casing and is formed to be attached to the well.

The drive means includes an electric motor which is mounted to rotate the drum, the motor including means to accommodate jamming of the water pipe. The motor has a drive shaft connected to rotate the drum, and the means to accommodate jamming comprises free mounting of the electric motor only on the shaft to permit rotation of the motor about the shaft unless rotation of the motor is inhibited. Thus, jamming while the motor is operating can be accommodated by allowing the operator to stop the motor before damage occurs.

An auxiliary winch is also provided secured to the frame. The winch can be used for at least two purposes, first to act as an auxiliary means for removal of the submersible pump by attachment to the rope or cable attached to the pump, and second as a winch for attachment to an immobile object in order to facilitate movement of the frame and drum.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
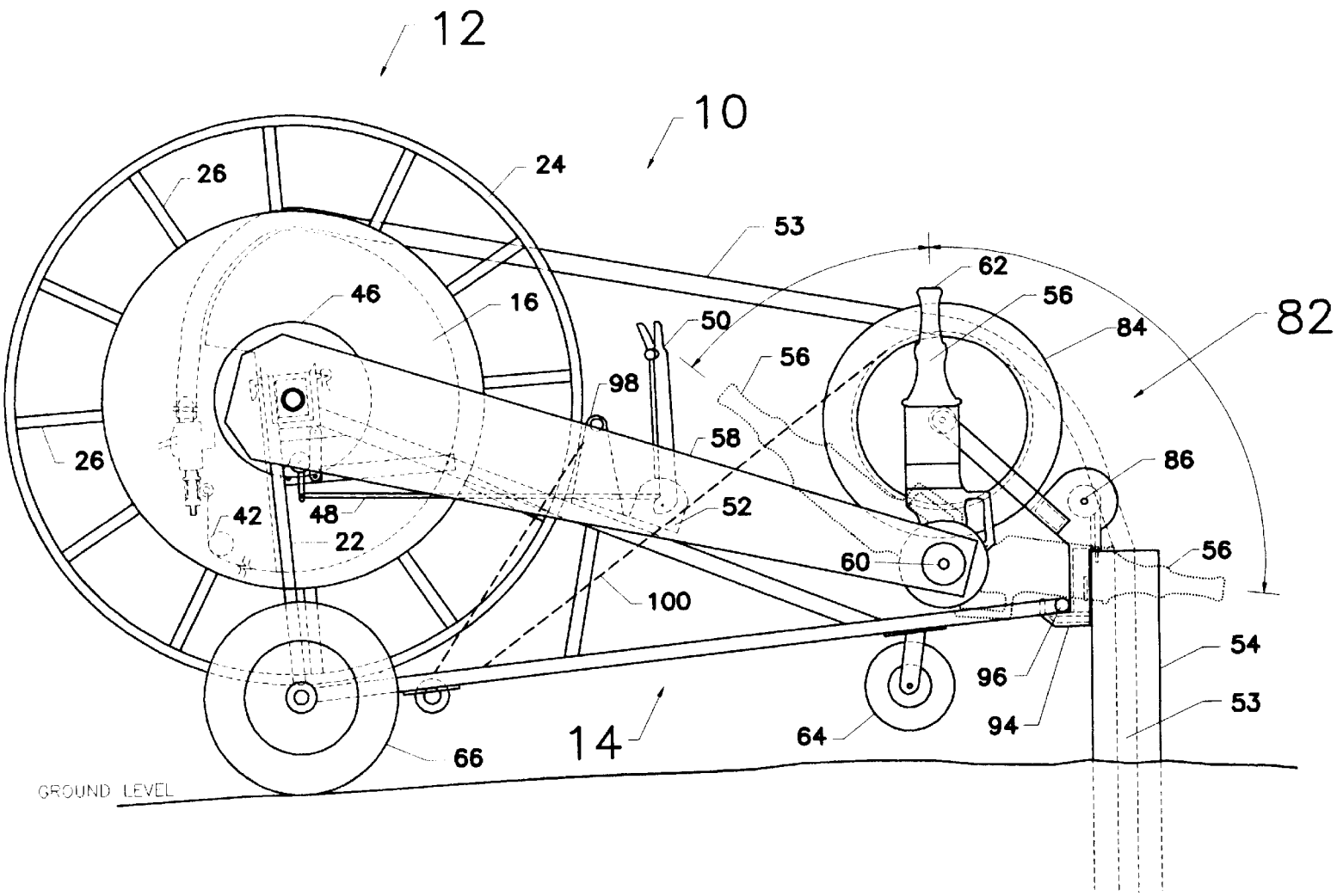
FIG. 1 is a side elevational view of an apparatus according to the invention, when shown mounted on a well casing, and showing in phantom various positions of the electric motor used for driving the pipe accumulation drum.
Figure 2:
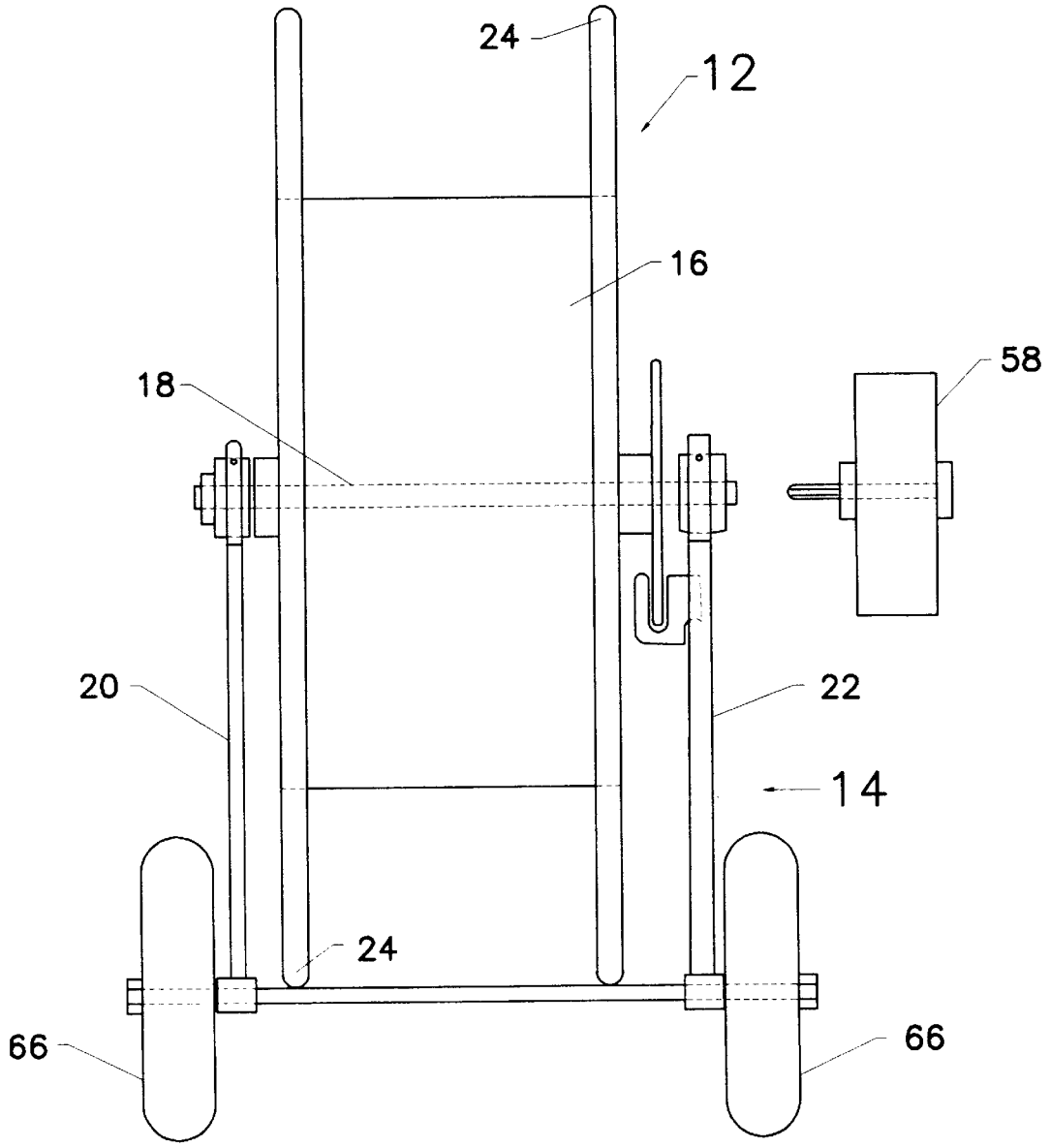
FIG. 2 is a rear elevational view of the apparatus shown in FIG. 1, with portions removed for clarity, and showing the drum gear drive disconnected from the apparatus.
Figure 3:
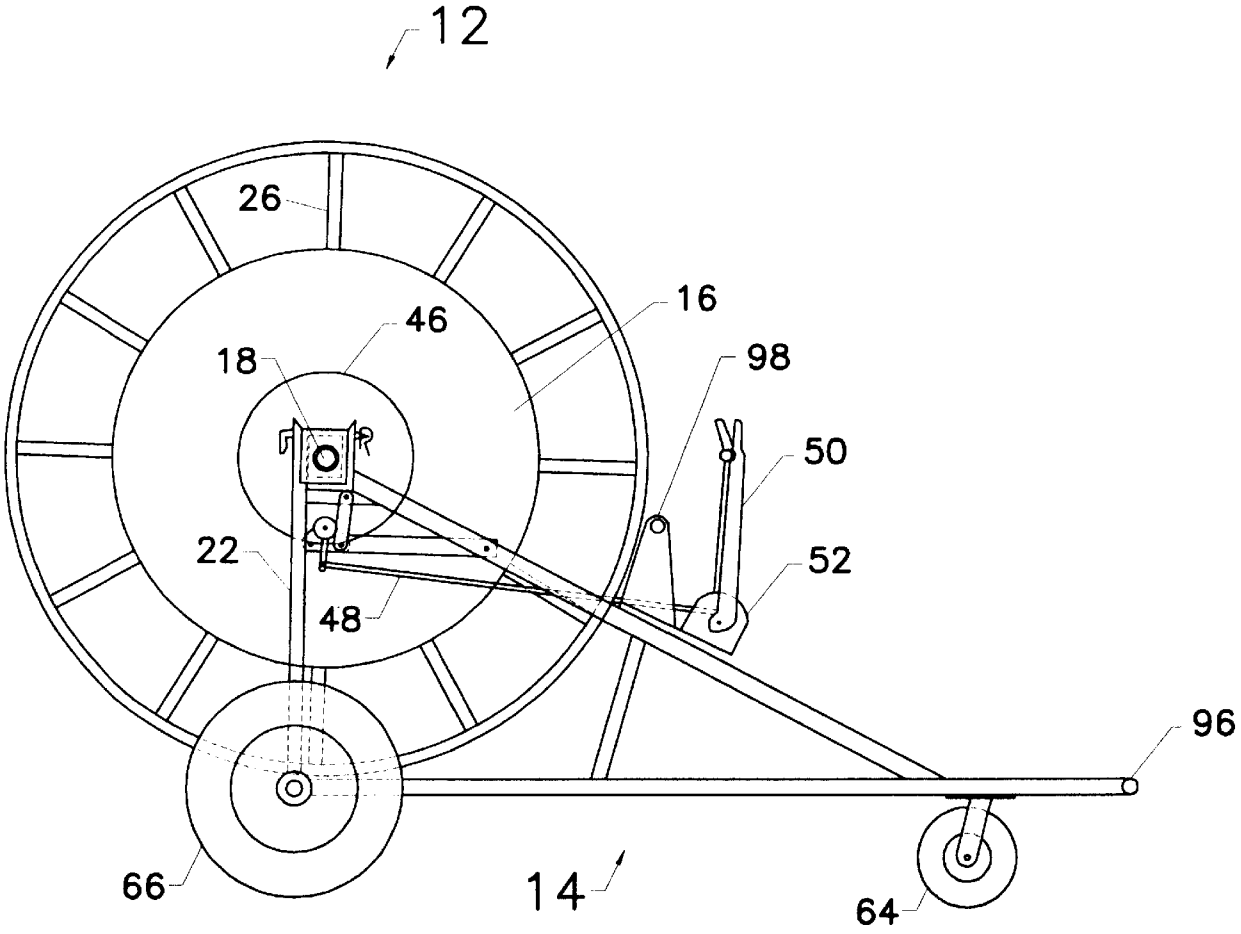
FIG. 3 is a side elevational view of the apparatus according to the invention, but with the drive removed, with the pipe guide not illustrated, and with the apparatus not being mounted adjacent to a well.
Figure 4:
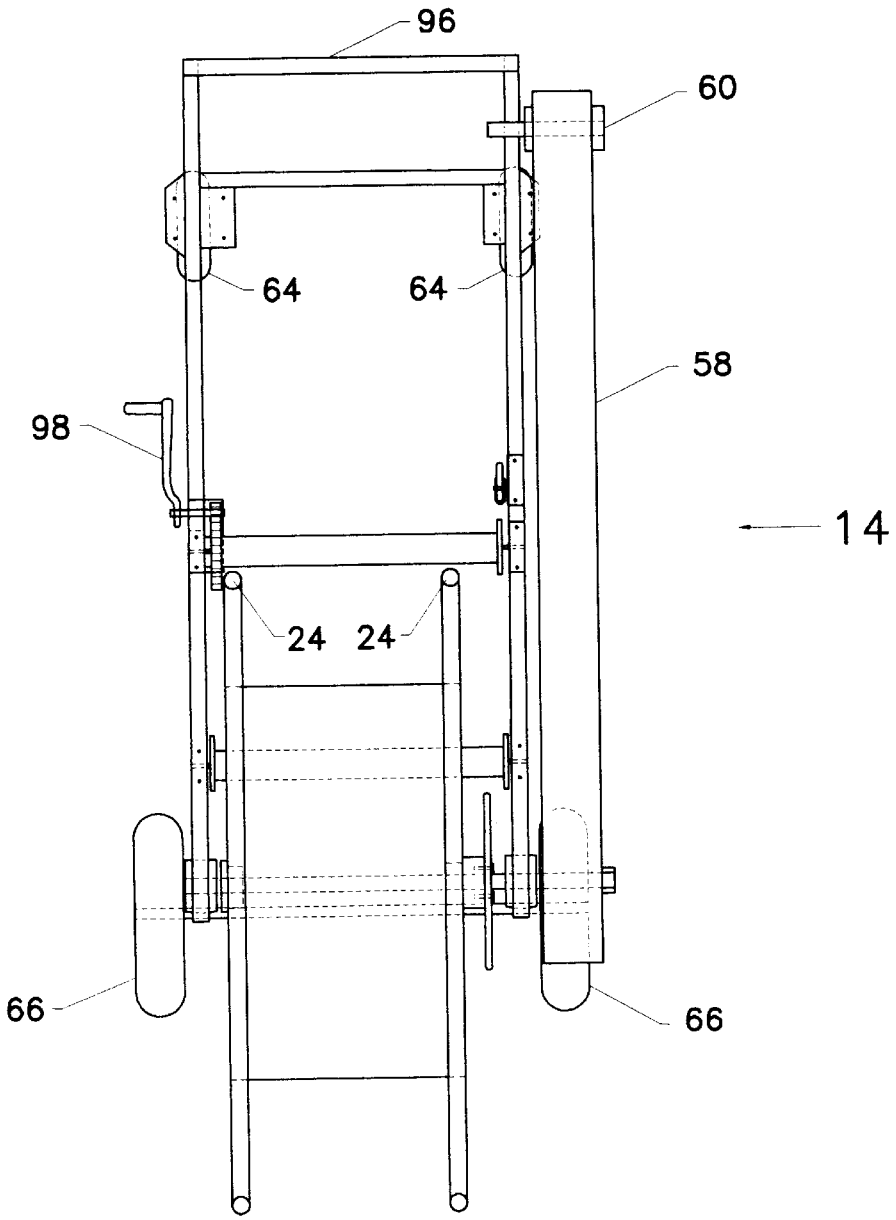
FIG. 4 is a top plan view of the apparatus illustrated in FIG. 1, but with the pipe guide removed to illustrate detail and with the apparatus not being mounted on a well casing.

An apparatus according to the invention for raising and lowering a submersible pump in a well is designated generally at 10 in the drawing figures. The apparatus 10 includes a large cylindrical drum 12 mounted for rotation in a frame 14. The frame 14 may be made of conventional metal tubular frame members or the like, and includes various elements for mounting the various parts of the apparatus 10, as described in further detail below. Since the frame 14 may be constructed of conventional frame elements, it is not described in further detail.

The cylindrical drum 12 is composed of a central hub 16 mounted on an axle 18 extending between upstanding arms 20 and 22 of the frame 14. Appropriate bearings are provided to permit free rotation of the cylindrical drum 12 in the frame 14.

The cylindrical drum 12 includes spaced circular rings 24 which are secured to the hub 16 by means of a series of spokes 26. Therefore, flexible water pipe can be wound onto the cylindrical drum 12 between the ring/spoke structures 24, 26 when the cylindrical drum 12 is rotated.

Figure 6:
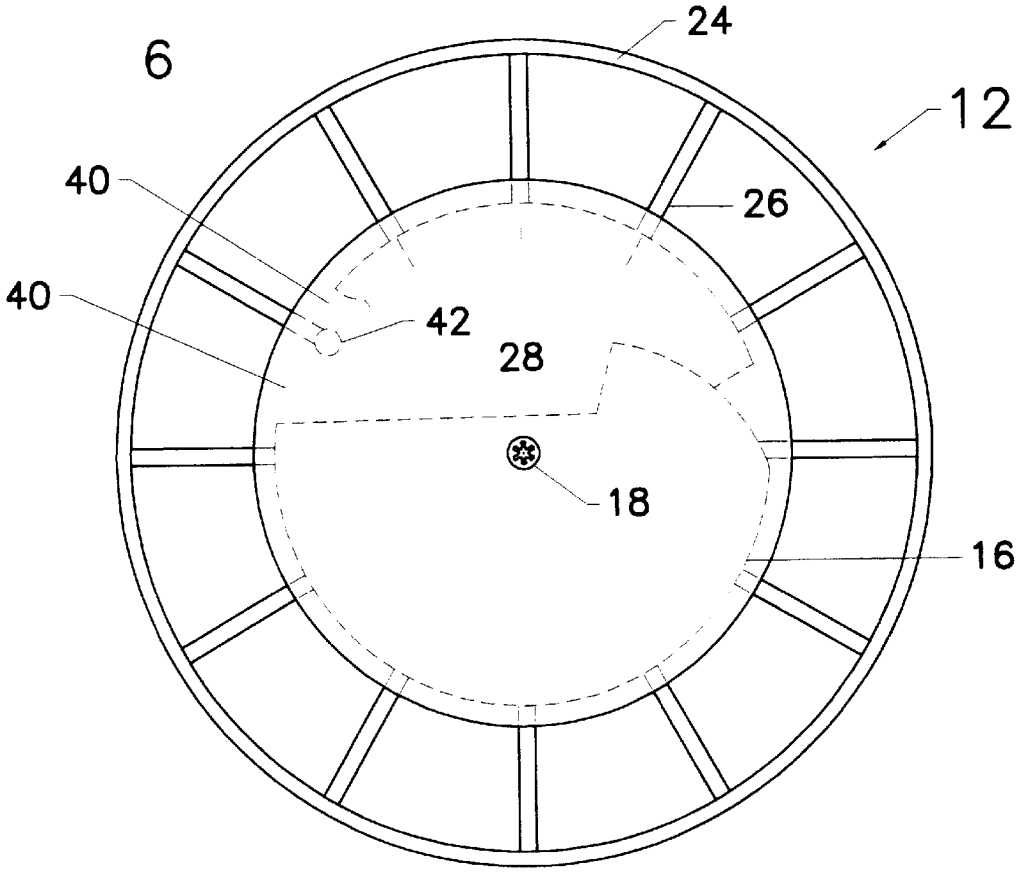
FIG. 6 is an enlarged side elevational view of the cylindrical drum of the invention, illustrating schematically the cavity formed in the drum.
Figure 6A:
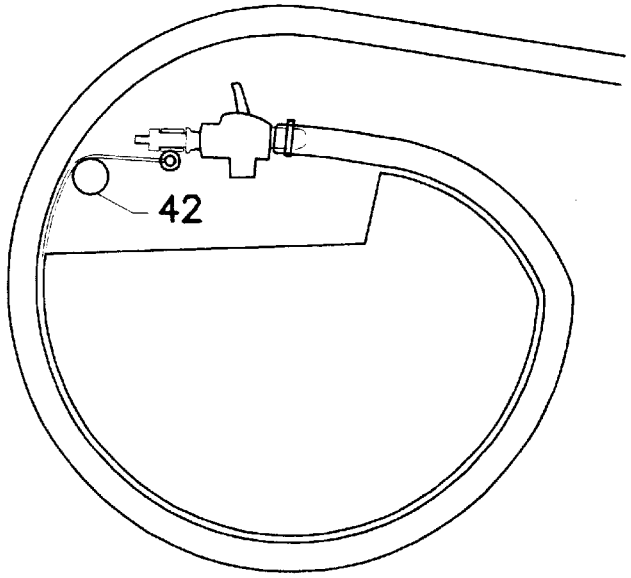
FIG. 6A is a further enlarged cross-sectional view of a portion of the cylinder-drum of the invention, with the remainder removed, illustrating schematically the winding of the tubing on the drum and the pitless adaptor being situated in the cavity.
Figure 7:
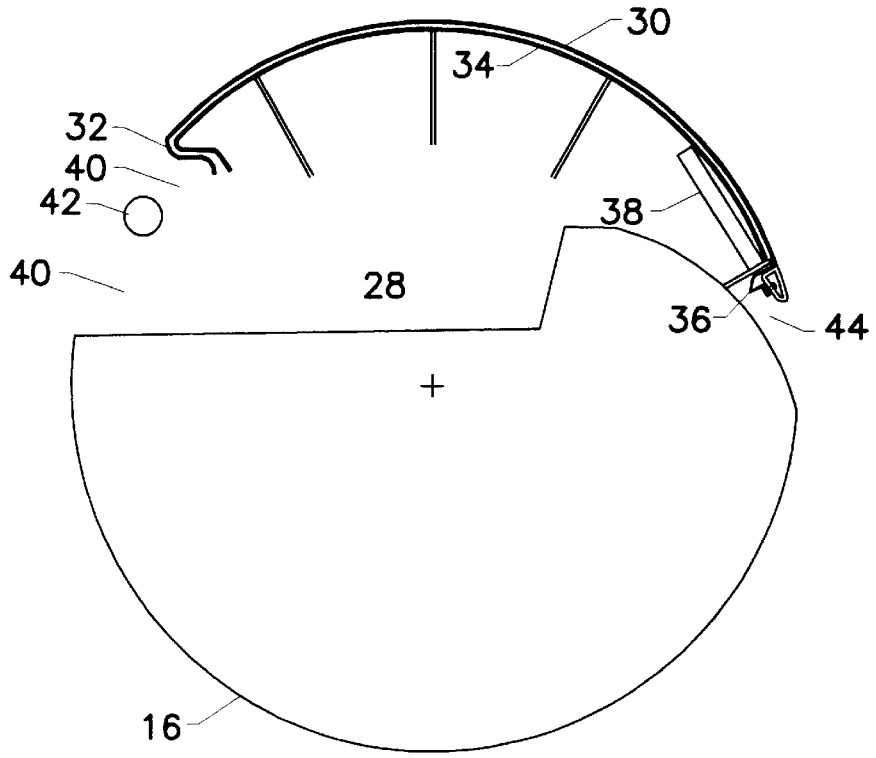
FIG. 7 is a schematic illustration of the hub portion of the drum of FIG. 6, showing the cavity and a cover for the cavity.
Figure 8:
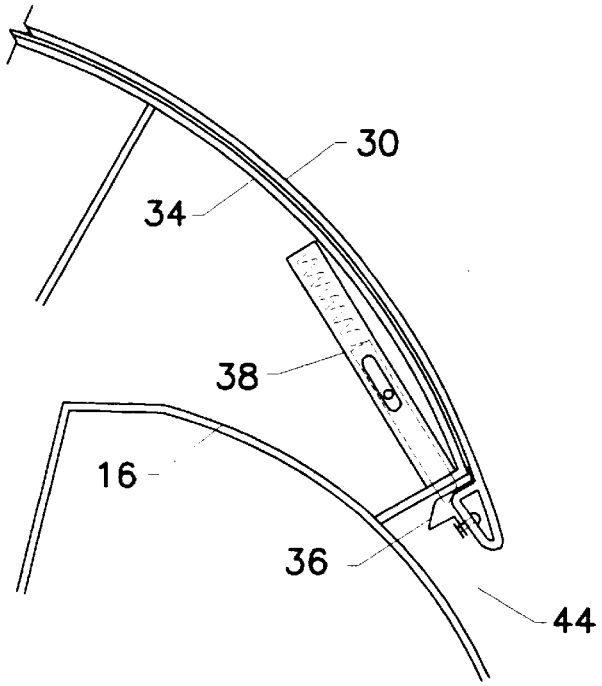
FIG. 8 is an enlarged side elevational view of a portion of the cover for the drum cavity.

The hub 16 of the cylindrical drum 12 includes a cavity 28 (FIGS. 6 and 7). The cavity is formed to accommodate a pitless connector, well seal, or any other element which might be located at the top of the flexible water pipe withdrawn from a well. The hub 16 is otherwise cylindrical, and to complete the cylindricality of the hub in order to accommodate flexible water pipe reeled thereon, a cover 30 is provided over the cavity 28. The cover 30 includes a hinge end 32 which is engaged on internal frame members 34 of the hub 16. The opposite end of the cover 30 includes a striker plate 36 which engages and snaps over a spring-loaded striker 38 mounted in the internal frame members 34. Thus, the cover 30 may be snapped in place as shown in the drawing figures to complete a generally cylindrical outer surface of the hub 16. At the same time, gaps are formed at opposite ends of the cover 30, a first gap 40 on both sides of a pipe 42 to accommodate tying a safety rope to the pipe 42 and a second gap 44 of sufficient width to allow flexible water pipe to pass therethrough into the internal cavity 28. The pipe 42 is located as a convenient place for tying rope or cord (not illustrated) extending from and connected to the adaptor (or other connector) at the top of the flexible water pipe located in the well.

A disk brake 46 is mounted on the cylindrical drum 12 at the hub 16, as illustrated. The disk brake may be conventional, and is connected by a link 48 to a hand lever 50. The hand lever 50 may also be conventional and includes a ratchet 52 to hold the hand lever in place and therefore retain, in a conventional fashion, a desired amount of braking force applied to the disk brake 46. The brake 46 is used to control revolution of the cylindrical drum 12, particularly when a submersible pump at the end of a flexible water pipe 53 is being lowered into the casing 54 of a well.

A motor 56 is provided for driving the cylindrical drum 12 through a gear box 58. Gearing between the motor 56 and the cylindrical drum 12 may be conventional, and therefore the details of the gear box 58 are not described further. Depending on the rotational speed of the motor 56, the gear box 58 can be used for gear reduction purposes, as well as connection between the motor 56 and the cylindrical drum 12. All of this is well known to one skilled in the art. While the motor 56 is preferred, it can, in many instances, be replaced by a hand crank. The gear ratio of the gear box 58 can permit hand cranking.

The motor 56 is mounted on a drive shaft 60 extending to the gear box 58. The motor 56 is not secured to the frame 14 or any other portion of the apparatus 10, and is therefore free to rotate about the drive shaft 60. The extent of possible rotation of the motor 56 is shown in phantom in FIG. 1, with rotation of the motor 56 being inhibited only by the structure of the apparatus 10 and the formation of the housing for the motor 56.

The motor 56, due to its rotation about the drive shaft 60, accommodates any jamming of water pipe 53 or the submersible pump (not illustrated) when being withdrawn up the well casing 54. The motor 56 is hand-held at a grip 62, and is normally operated in the upright orientation illustrated in FIG. 1. It can be moved between the extremes shown in phantom. If, for any reason, when the motor 56 is being operated, rotation of the cylindrical drum 12 is inhibited or withdrawal of the water pipe and submersible pump from the well casing 54 is inhibited, torque of the motor 56 will cause the motor to begin to rotate to the right in relation to FIG. 1. This normally causes the operator to release the grip 62 and a power switch thereon (not illustrated), permitting the motor 56 to stop and thus preventing any damage to the apparatus 10, or the water pipe 53 or the submersible pump.

Figure 5:
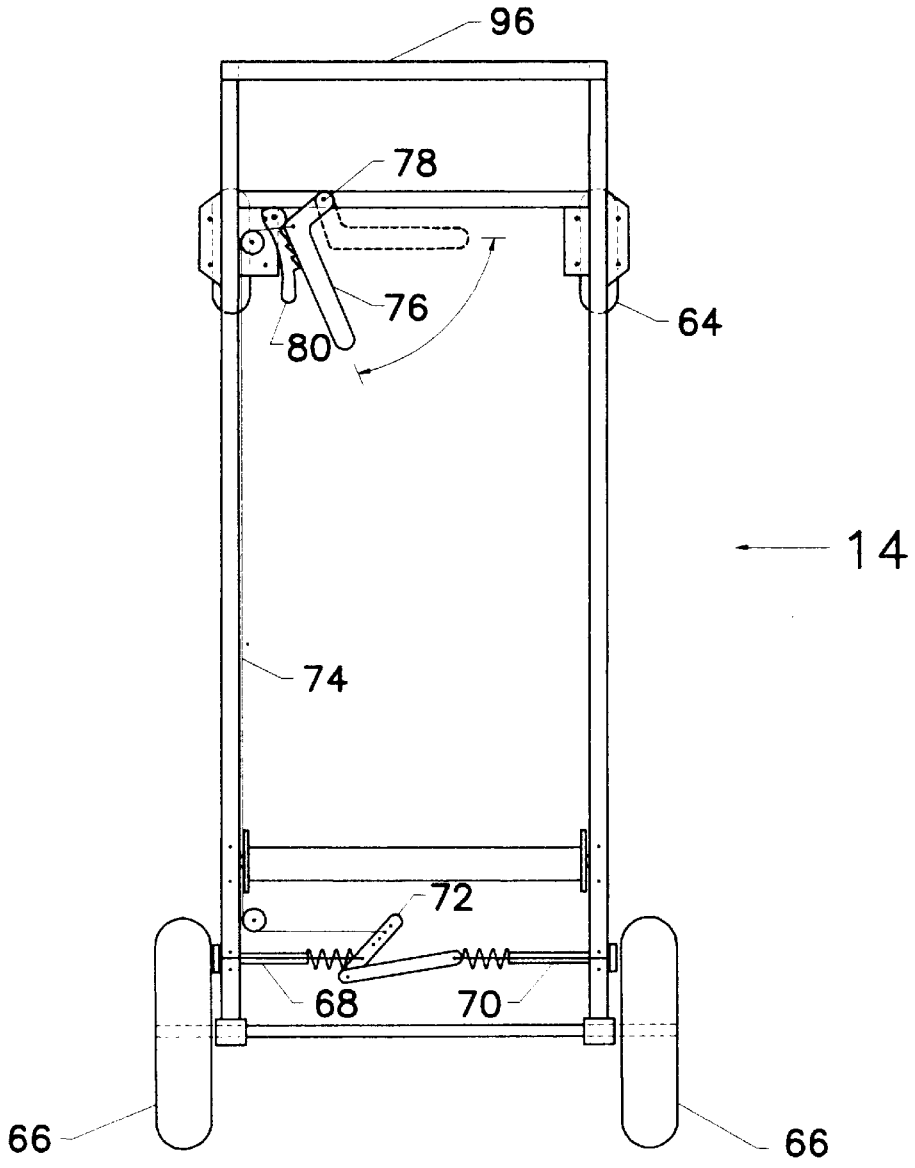
FIG. 5 is a top plan view of the frame for the apparatus illustrated in FIG. 1, and showing the braking apparatus for the wheels of the frame.

The frame 14 is mounted on a pair of front wheels 64 and a pair of rear wheels 66. As best shown in FIG. 5, a braking mechanism is employed to lock the wheels 66 in place. Opposite brakes 68 and 70 act on the wheels 66 through an actuation lever 72 which is connected by a cable 74 to a further hand-operated lever 76. The lever 76 is mounted to the frame on a pivot 78 and can be locked in place, as shown in phantom, by means of a ratcheted pivotal brake lock 80. Once the brakes 68 and 70 are locked against the wheels 66, the apparatus 10 won't roll and can be held in place.

Figure 9:
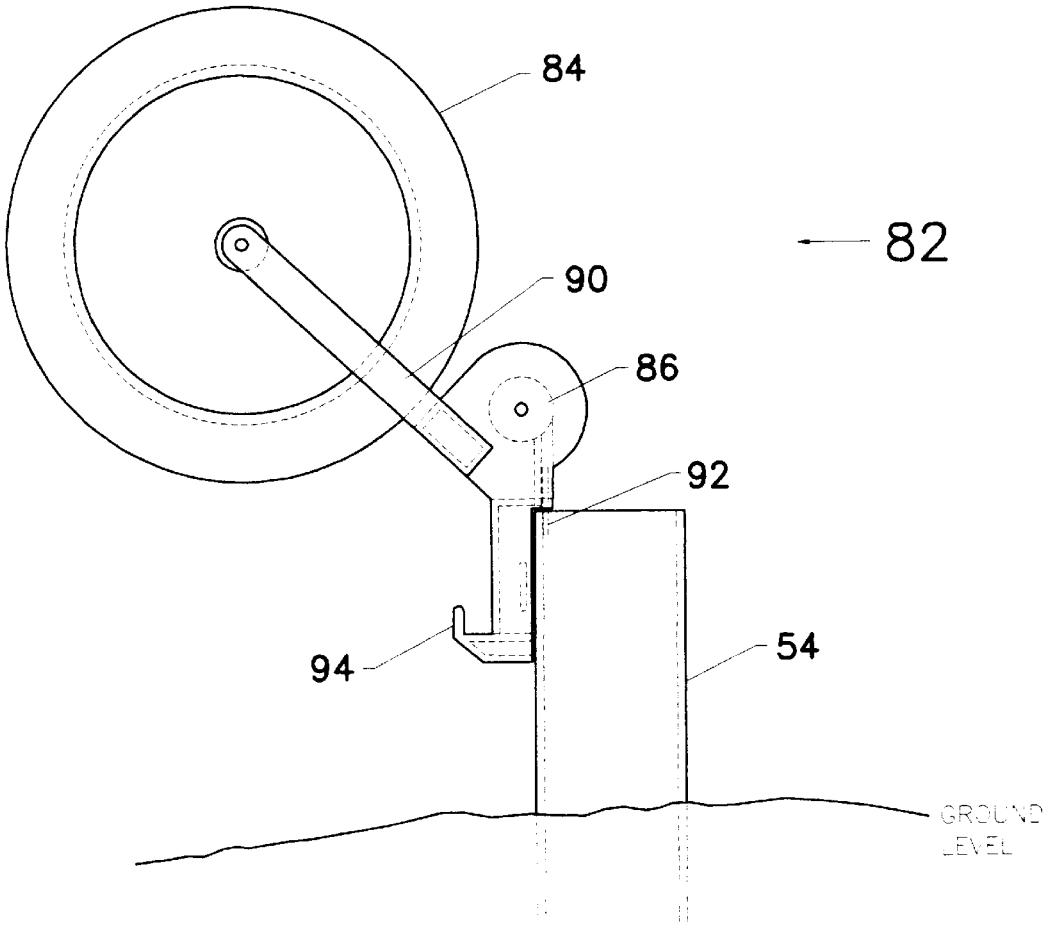
FIG. 9 is a side elevational view of the guide means according to the invention, when mounted on a well casing.
Figure 10:
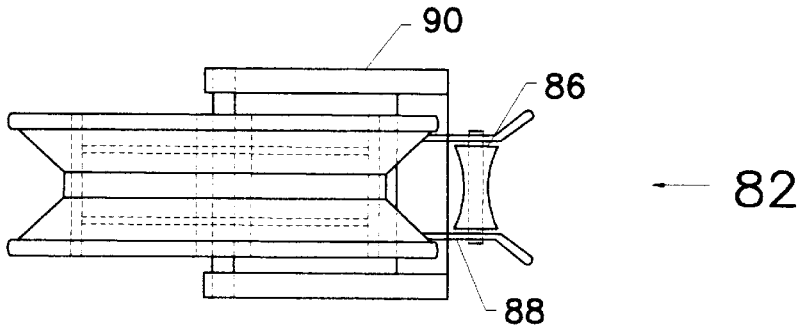
FIG. 10 is a top plan view thereof.
Figure 11:
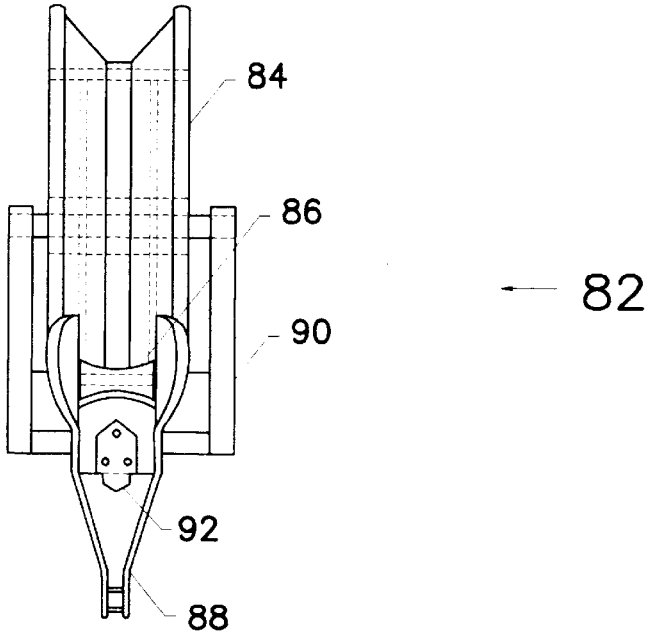
FIG. 11 is an end elevational view thereof.

For guiding of the flexible water pipe 53 from the well casing 54, a guide 82 is provided. The guide 82 is composed of a relatively large guide roller 84 and a small alignment roller 86. As best shown in FIGS. 9 through 11, both rollers 84 and 86 are cupped in cross-section to accommodate flexible water pipe emanating from the well casing 54. The guide roller 84 may be lined with rubber or some other soft material to prevent damage to the water pipe, and the roller 86 may be similarly formed. As shown, the roller 86 is mounted in a bracket 88 which includes extending arms 90 for mounting of the guide roller 84. A depending finger 92 extends from the bracket 88, and is spaced therefrom so that when the bracket 88 is installed on the casing 54, the wall of the casing is sandwiched with bracket extending on the outside of the casing 54 while the finger 92 extends along the interior wall of the casing 54 in order to firmly mount the bracket 88 and the guide rollers 82 and 84 in place.

The bracket 88 also includes an extended support 94. As best shown in FIG. 1, the support 94 is shaped to accommodate a handle 96 of the frame 14 in order for the apparatus 10 to be mounted in proper proximity to the well casing 54.

A winch 98 is also provided, secured to the frame 14. The winch 98 is used in a conventional fashion for winding cable or rope thereon, and a cable 100 extending therefrom is shown schematically in FIG. 1. The cable 100 can be connected to a rope or cable extending from the submersible pump (not illustrated) located in the well, or can be connected to an immobile object so that the winch 98 can be used to assist movement of the apparatus 10. This is particularly advantageous when the apparatus 10 is fully loaded with flexible water pipe and is to be situated in the rear bed of a vehicle. The winch 98 can be used to winch the apparatus 10 up a ramp to the bed of the vehicle.

Figure 13:
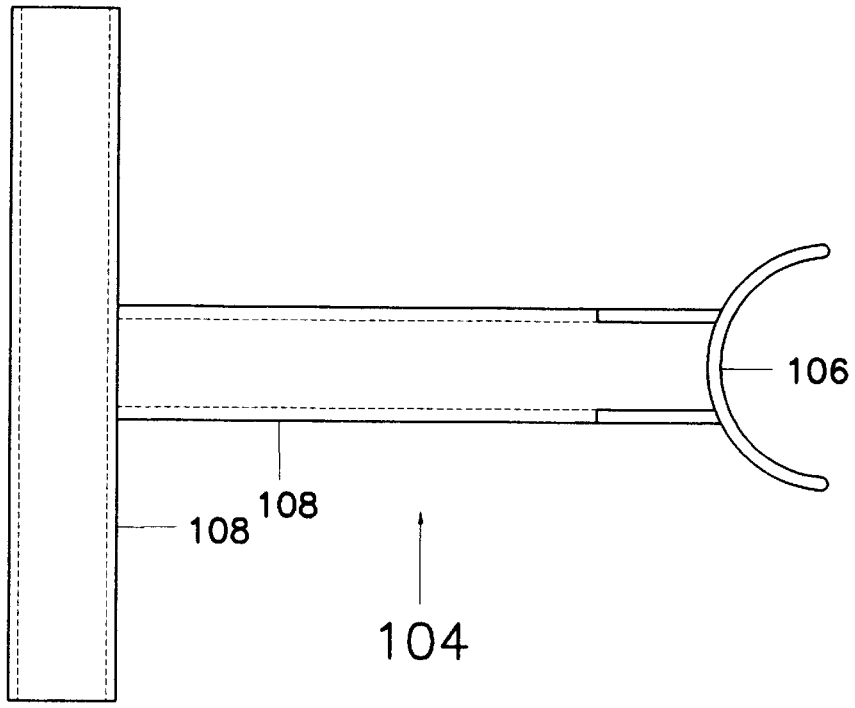
FIG. 13 is a top plan view of an adaptor optionally used for connection to a well pipe casing.
Figure 14:
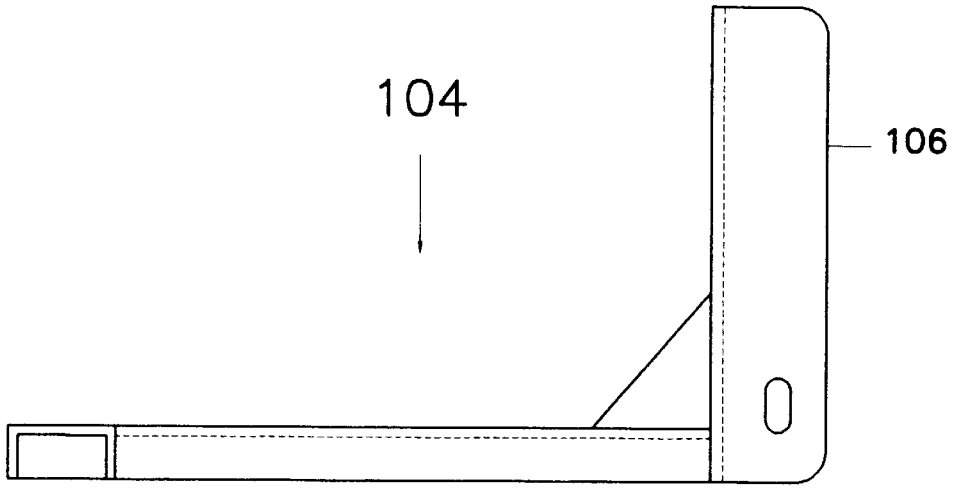
FIG. 14 is a side elevational view thereof.

As shown in the drawing figures, it is preferred that the apparatus 10 be mounted directly on a well casing 54 which extends above ground level 102. If the casing 54, however, is insufficiently tall, then a supplementary brace 104 (FIGS. 13 and 14) can be used. The brace 104 includes a curved portion 106 adapted to be fitted against the well casing 54, and a T-shaped leg 108 for stability. The curved portion 106 can be connected in any conventional manner to the well casing 54, such as by a strap or the like (not illustrated).

As is well known to one skilled in the art, the flexible water pipe within the well casing 54 extends only to a location sufficiently below ground, below what would be the expected frost line, in order to avoid freezing. The water pipe is normally topped by a pitless adaptor or the like (not illustrated). The adaptor must be engaged below ground in order to initiate removal of the flexible water pipe and submersible pump from the well, and one such means of doing so illustrated in FIG. 12.

Figure 12:
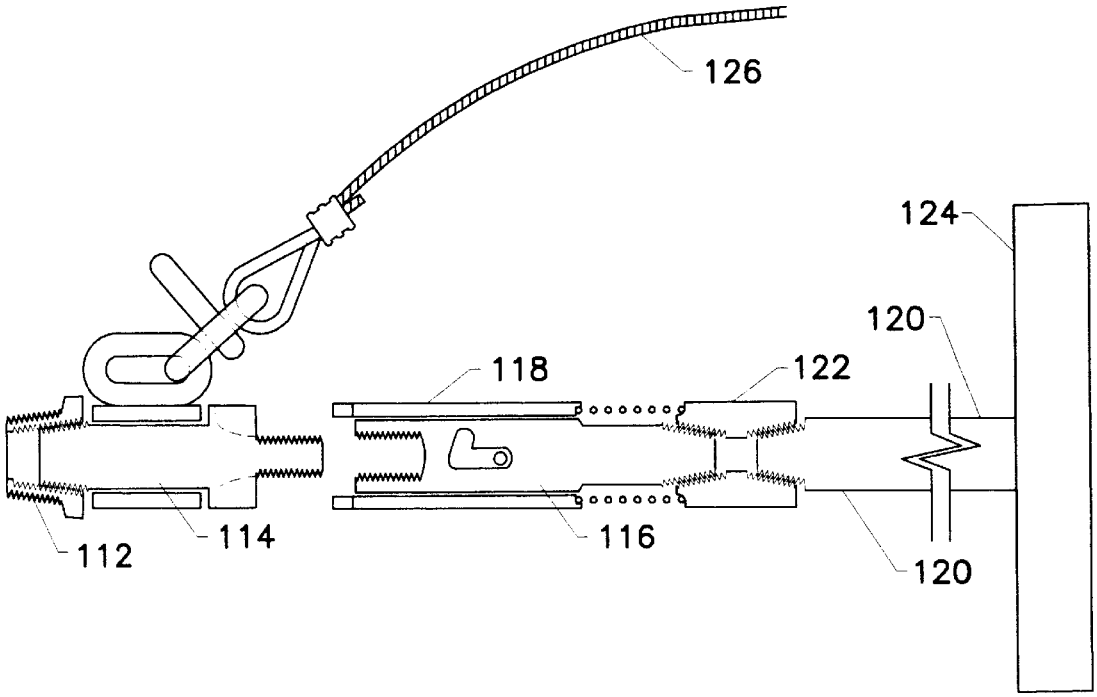
FIG. 12 is a schematic illustration of an apparatus used to connect to a pitless adaptor located at the top of the flexible water pipe below the frost line.

FIG. 12 illustrates a key 110 which is used to connect cable to the top of a pitless adaptor or other similar device located underground and connected to the flexible water pipe leading to the submersible pump. The key 110 includes a bushing 112 connected to a shaft 114 which is further engaged by a shaft 116 having a spring-loaded locking collar 118. A handle 120 is connected to the shaft 116 by means of a coupling 122. The handle 120 has sufficient length to engage the bushing 112 in the pitless adaptor, and an appropriate cable arrangement 126 extends from the shaft 114 for connection to the pipe 42 (FIG. 7) for initial hoisting of the flexible water pipe and submersible pump from the well. The handle 120 is topped by a grip 124 to facilitate rotation.

In use of the apparatus 10, first any cap is removed from the well casing 54 for interior access. The guide 82 is then placed on the well casing 54 (or on the adaptive brace 104 if needed), and the remaining portion of the apparatus 10 is moved in place, with the handle 96 being engaged in the support 94 of the guide 82. The key 110 is then used to attach cable from the cylindrical drum 12 to the pitless adaptor (not illustrated) in the casing 54. With the initial connection thus being made, the motor 56 is activated to begin hoisting the flexible water pipe and the submersible pump within the casing 54. When the top of the water pipe, having the pitless adaptor, reaches the cylindrical drum 12, the pitless adaptor is situated in the cavity 28, and the cover 30 is placed over the cavity. Then, the motor 56 continues to be activated, turning the cylindrical drum 12 to reel the water pipe on the drum 12, until the submersible pump is located at the top of the casing 54. The pump can then be lifted from the casing 54, repaired or replaced, and the process is then repeated in the opposite direction to return the submersible pump to the appropriate elevation within the casing 54.

Many benefits are enjoyed by use of the present invention. Because of the cylindrical drum, the flexible water pipe, electrical wire for the submersible pump and safety rope or cable for the pump are all carried together and the removal is far more sanitary because the water pipe never touches the ground. Power drive by means of the rotatable motor 56, which is hand-held by an operator, prevents any abrupt stops if a jam occurs, therefore avoiding damage to the apparatus 10, to the water pipe, or to the submersible pump. Also, because the cylindrical drum 12 is spaced from the well casing 54, and the guide 82 is situated at one side thereof, not only is full access to the interior of the casing 54 assured, but also there is sufficient room between the cylindrical drum 12 and the guide 82 for the operator to inspect and repair emerging wires and the water pipe.

Various changes can be made to the invention without departing from the spirit thereof or scope of the following claims.

What is claimed is:

1. An apparatus for raising and lowering a submersible pump in a well, comprising a. a cylindrical drum for accumulating flexible water pipe, b. means for mounting said drum for rotation at one side of the well and spaced from the well, c. a cavity in said drum for accommodating a connector situated at a top end of the water pipe, and including a movable cover for alternatingly exposing and covering said cavity, d. guide means for guiding water pipe from the well to said drum, and e. drive means for rotating said drum.

2. An apparatus according to claim 1 in which said mounting means comprises a cart having an elongated frame.

3. An apparatus according to claim 2 in which said frame includes means for mounting one end of said frame on said guide means.

4. An apparatus according to claim 3 in which said means for mounting one end comprises a handle.

5. An apparatus according to claim 2 in which said cart includes a series of wheels for portability.

6. An apparatus according to claim 5 including brake means for inhibiting rotation of at least one of said wheels.

7. An apparatus according to claim 1 in which said cavity is located in a central hub of said drum.

8. An apparatus according to claim 7 including means to hingedly secure said cover on said hub.

9. An apparatus according to claim 1 including a brake for said drum.

10. An apparatus according to claim 9 including a hand lever for operating said brake.

11. An apparatus according to claim 1 in which said guide means comprises a guide roller mounted for rotation in a bracket, said bracket including means for attachment at the well.

12. An apparatus according to claim 11 in which said bracket includes means for retaining one end of said mounting means.

13. An apparatus according to claim 1 including an adaptor for securing said guide means to the well.

14. An apparatus according to claim 13 in which said adaptor comprises an upstanding brace formed to be attached to the well.

15. An apparatus according to claim 1 including an auxiliary winch secured to said mounting means.

16. An apparatus for raising and lowering a submersible pump in a well, comprising a. a cylindrical drum for accumulating flexible water pipe, b. means for mounting said drum for rotation at one side of the well and spaced from the well, c. cavity means in said drum for accommodating a connector situated at a top end of the water pipe, d. guide means for guiding water pipe from the well to said drum, said guide means comprising a guide roller mounted for rotating in a bracket, said bracket including means for attachment at the well, said attachment means comprising a depending finger spaced from and secured to said bracket, and e. drive means for rotating said drum.

17. An apparatus according to claim 16 including an alignment roller secured in said bracket in registration with said guide roller.

18. An apparatus for raising and lowering a submersible pump in a well, comprising a. a cylindrical drum for accumulating flexible water pipe, b. means for mounting said drum for rotation at one side of the well and spaced from the well, c. cavity means in said drum for accommodating a connector situated at a top end of the water pipe, d. guide means for guiding water pipe from the well to said drum, and e. drive means for rotating said drum, said drive means including an electric motor mounted to rotate said drum, said electric motor including means to accommodate jamming of the water pipe.

19. An apparatus according to claim 18 in which said electric motor includes a drive shaft connected to rotate said drum, and said means to accommodate jamming comprises mounting of said electric motor on said shaft to permit rotation of said motor about said shaft unless inhibited.

* * * * *